US007283639B2

(12) United States Patent
Kariniemi

(10) Patent No.: US 7,283,639 B2
(45) Date of Patent: Oct. 16, 2007

(54) HEARING INSTRUMENT WITH DATA TRANSMISSION INTERFERENCE BLOCKING

(75) Inventor: Robert Kariniemi, Plymouth, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 520 days.

(21) Appl. No.: 10/797,317

(22) Filed: Mar. 10, 2004

(65) Prior Publication Data

US 2005/0201577 A1 Sep. 15, 2005

(51) Int. Cl.
*H04R 25/00* (2006.01)

(52) U.S. Cl. ..... 381/312; 381/314; 381/315

(58) Field of Classification Search ..... 381/94.1, 381/94.2, 312, 314, 315, 320, 321, 323; 379/52
See application file for complete search history.

(56) References Cited

U.S. PATENT DOCUMENTS 4,845,755 A 7/1989 Busch et al.
4,965,822 A * 10/1990 Williams ..... 379/406.08
5,202,927 A 4/1993 Topholm
5,539,858 A * 7/1996 Sasaki et al. ..... 704/212
5,721,783 A 2/1998 Anderson
6,044,164 A * 3/2000 Ach-Kowalewski ..... 381/314
6,768,802 B1 * 7/2004 Baechler ..... 381/315
6,839,446 B2 * 1/2005 Blumenau ..... 381/312
2003/0044033 A1 3/2003 Julstrom et al.
2003/0138116 A1 * 7/2003 Jones et al. ..... 381/94.1

OTHER PUBLICATIONS

Goodman et al., "Waveform Substitution Techniques for Recovering Missing Speech Segment in Packet Voice Communications," IEEE Trans. on ASSP, vol. 34, No. 6, Dec. 1986, pp. 1440-1448.*
International Search Report filed in corresponding PCT Application No. PCT/US2005/007558, (Aug. 31, 2005), 7 pgs.

* cited by examiner

*Primary Examiner*—Huyen Le
(74) *Attorney, Agent, or Firm*—Schwegman, Lundberg & Woessner, P.A.

(57) ABSTRACT

One aspect relates to a method to block data transmission interference from an input of a receiver in a hearing instrument. In various embodiments, an acoustic-based signal representative of sound received at a microphone system is received. It is determined if a trigger associated with a data transmission has occurred. A signal representative of the acoustic-based signal is presented to the input of the receiver when the trigger has not occurred such that the receiver converts the acoustic-based signal into an output acoustic signal. The signal representative of the acoustic-based signal is blocked from the input of the receiver when the trigger has occurred such that data transmission interference is blocked from being converted into the acoustic signal. In various embodiments, the method further comprises presenting a signal representative of a substitute waveform to the input of the receiver when the trigger has occurred. Other aspects are provided herein.

29 Claims, 6 Drawing Sheets

HEARING INSTRUMENT WITH DATA TRANSMISSION INTERFERENCE BLOCKING

TECHNICAL FIELD

This application relates generally to hearing instruments with data communication capabilities and, more particularly, to methods, devices and systems to block interference associated with data transmission from an input of a hearing aid receiver.

BACKGROUND

Hearing aids include a microphone. The microphone converts acoustic signals into an electrical signal, referred to herein as an acoustic-based signal. The electrical signal is processed, and the resulting processed signals also can be referred to as an acoustic-based signal or a signal representative of an acoustic-based signal. Hearing aids also include a receiver which functions as a speaker. The acoustic-based signal is processed and presented to the receiver, which transforms the acoustic-based signal into an audible sound wave, herein referred to as an output acoustic signal. The microphone and receiver form part of an acoustic signal processing section of the hearing aid.

Hearing aids also include communication or data transmission components used to communicate with devices that are external to the hearing aid. One example of data transmission components includes wireless transceivers, such as those used to wirelessly communicate with hearing aid programmers. Programmers are used to program various functions of the hearing aid. The transceivers are also able to wirelessly communicate with other hearing aids, or with assisted listening devices. The transceiver forms part of a data signal processing section of the hearing aid.

Data transmission signals generate radio frequency (RF) waves, which can interfere with the acoustic signal processing section of the hearing aids. The microphone is particularly vulnerable to interference from the data transmission signals. The interference picked up by the microphone is propagated within the acoustic-based signal, and is transformed into an unpleasant output acoustic signal by the receiver.

There is a need in the art to provide an improved hearing instrument that does not transform data transmission interference into unpleasant output acoustic signals.

SUMMARY

The above-mentioned problems are addressed by the present subject matter and will be understood by reading and studying the following specification. Various aspects and embodiments of the present subject matter block interference associated with the data transmission from reaching the receiver. Various embodiments provide silence to a user of the hearing aid for a brief time period associated with the duration of the data transmission. Various embodiments provide a substitute sound to a user of the hearing aid by providing a substitute waveform to the receiver. In various embodiments, the substitute waveform is calculated or processed according to the sounds received by the microphone immediately preceding the proposed interference such that the waveform has the same frequency (pitch) and amplitude (volume). Additionally, in various embodiments, the ends of the substitute waveform are appropriately adjusted or annealed to connect the ends with the preceding and succeeding waveforms such that the hearer does not experience an audible break in the output acoustic signal during the data transmissions and the transitions leading in to and out from the data transmissions.

One aspect of the present subject matter relates to a method to block data transmission interference from an input of a receiver in a hearing instrument. According to various embodiments of the method, an acoustic-based signal representative of sound received at a microphone system is received. It is determined if a trigger associated with a data transmission has occurred. A signal representative of the acoustic-based signal is presented to the input of the receiver when the trigger has not occurred such that the receiver converts the acoustic-based signal into an output acoustic signal. The signal representative of the acoustic-based signal is blocked from the input of the receiver when the trigger has occurred such that data transmission interference is blocked from being converted into the acoustic signal. In various embodiments, the method further comprises presenting a signal representative of a substitute waveform to the input of the receiver when the trigger has occurred.

One aspect of the present subject matter relates to a hearing instrument. Various embodiments of the hearing instrument include a data receiver to receive a data transmission, a microphone system to generate an acoustic-based signal, and a hearing instrument receiver to receive and convert a signal representative of the acoustic-based signal into an output acoustic signal. The hearing instrument further includes means to block the acoustic-based signal for at least a portion of a time period when the data receiver receives a data transmission such that the output acoustic signal does not include noise attributed to the data transmission.

Various embodiments of the hearing instrument include a data receiver to receive a data transmission, a microphone system to generate an acoustic-based signal, and a switch. Various embodiments implement the switch using software, hardware or a combination of software and hardware. The switch has a first input and an output, and is configured to selectively connect the first input to the output. The hearing instrument includes a first signal path to carry a signal representative of the acoustic-based signal from the microphone system to the first input of the switch. The hearing instrument further includes a receiver to convert an output signal from the output of the switch into an output acoustic signal. The hearing instrument further includes a controller to receive a trigger signal indicative of a data transmission occurrence, and to communicate with the switch to selectively disconnect the first input from the output during at least a portion of the data transmission occurrence such that interference associated with the data transmission occurrence is not transferred to the hearing instrument receiver.

Various embodiments of the present subject matter store a predetermined amount of time (e.g. 1-50 ms) of audio in a circular buffer of the hearing aid using digital signal processing. As this audio data is sent to the receiver, the device receives data from a wireless antenna input of the hearing aid, and programs that data into non-volatile memory. A copy of the waveform just preceding the intended period of interference is formed, and presented to the receiver during the period of interference. Silence can be substituted instead of the waveform during the outage when the silence is not noticeable.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

The following detailed description of the present subject matter refers to the accompanying drawings which show, by way of illustration, specific aspects and embodiments in which the present subject matter may be practiced. These embodiments are described in sufficient detail to enable those skilled in the art to practice the present subject matter. Other embodiments may be utilized and structural, logical, and electrical changes may be made without departing from the scope of the present subject matter. References to "an", "one", or "various" embodiments in this disclosure are not necessarily to the same embodiment, and such references contemplate more than one embodiment. This description references signal transmission lines using labels, and to simplify the discussion, also references the signals transmitted on the signal transmission lines using the same labels. The following detailed description is, therefore, not to be taken in a limiting sense, and the scope of the present subject matter is defined only by the appended claims, along with the full scope of legal equivalents to which such claims are entitled.

Figure 1:
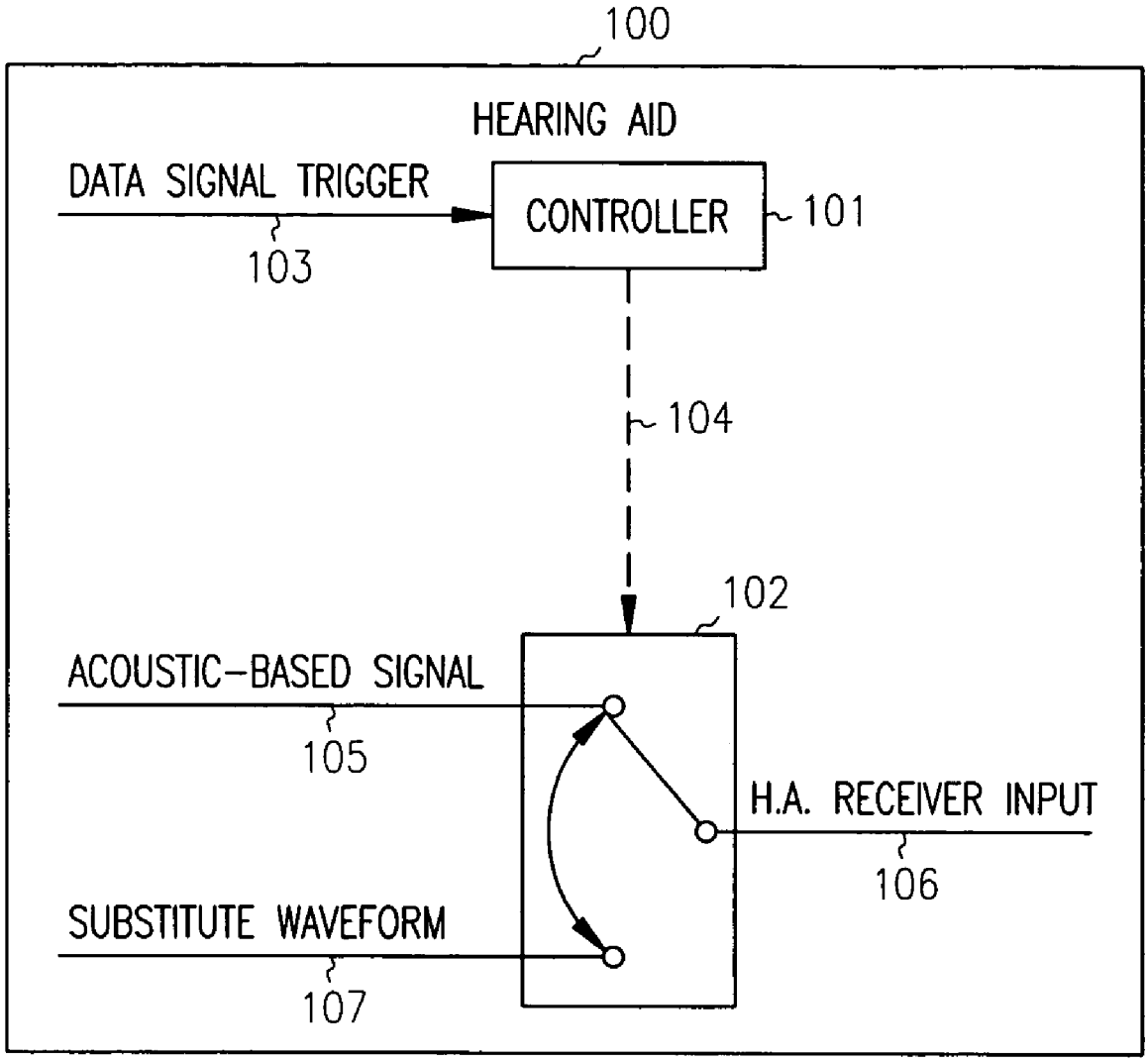
FIG. 1 illustrates a high-level block diagram of portions of a hearing instrument, according to various embodiments of the present subject matter.

FIG. 1 illustrates a high-level block diagram of portions of a hearing instrument, according to various embodiments of the present subject matter. The hearing instrument is illustrated as a hearing aid 100. Various portions of the hearing aid, such as the microphone system and the receiver of the acoustic signal processing section and the transceiver of the data signal processing section, are not illustrated in FIG. 1 to simplify the illustration and the corresponding discussion. A hearing aid embodiment, including the microphone system and the receiver, is discussed below with respect to FIG. 4.

The hearing aid 100 includes a controller 101 and a blocking module 102. One of ordinary skill in the art will understand, upon reading and comprehending this disclosure, that the controller 101 is used to control a number of hearing aid operations. As illustrated in FIG. 1, the controller 101 is adapted to receive a data signal trigger 103, and to appropriately control the blocking module 102 via control line 104 based on the data signal trigger 103.

The blocking module 102 receives an acoustic-based signal 105 from the microphone system. One of ordinary skill in the art will understand that the acoustic-based signal generated by the microphone system can be processed to reflect a processed signal representative of the acoustic based signal generated by the microphone system. Line 105 is intended to reflect the acoustic-based signal or any processed signal representative of the acoustic based signal. The blocking module 102 selectively passes the acoustic-based signal 105 through to the hearing aid receiver input 106. In response to a data signal trigger 103, the controller 101 controls the blocking module 102 to block the acoustic-based signal from passing through to the hearing aid receiver input 106. The blocking module 102 is illustrated as a switch to illustrate the blocking, or disconnect, function of the blocking module 102. One of ordinary skill in the art will understand, upon reading and comprehending this disclosure, that the switching function of the blocking module 102 can be implemented using software, using hardware, or using a combination of software and hardware. By blocking the acoustic-based signal from the input of the receiver in response to the trigger 103, the present subject matter blocks data transmission interference (e.g. RF signals picked up by the microphone and hybrid wiring) from being converted into the output acoustic signal.

In various embodiments, no significant signal is presented to the hearing aid receiver input 106 in response to the data signal trigger 103 such that, during a data transmission, the hearing aid receiver does not transmit an acoustic signal. In these embodiments, the hearing aid user is presented with silence during the data transmission. In these embodiments, the blocking module 102 can be illustrated as a disconnect switch that selectively disconnects the receiver input 106 from the acoustic-based signal 105.

In various embodiments, as illustrated in FIG. 1, the hearing aid provides a substitute waveform 107 that is passed to the hearing aid input 106 such that, during a data transmission, the hearing aid receiver transmits an acoustic signal corresponding to the substitute waveform. In various embodiments, the substitute waveform presented to the receiver results in a predetermined ambient sound. In various embodiments, the substitute waveform presented to the receiver results in a short duplication of a sound heard by the hearing aid user prior to the data transmission. The length of the substitute waveform is within a range of 1-50 ms in various embodiments. In various embodiments, the substitute waveform is calculated such that the listening experience of the hearing aid user is not noticeably interrupted.

Figure 2:
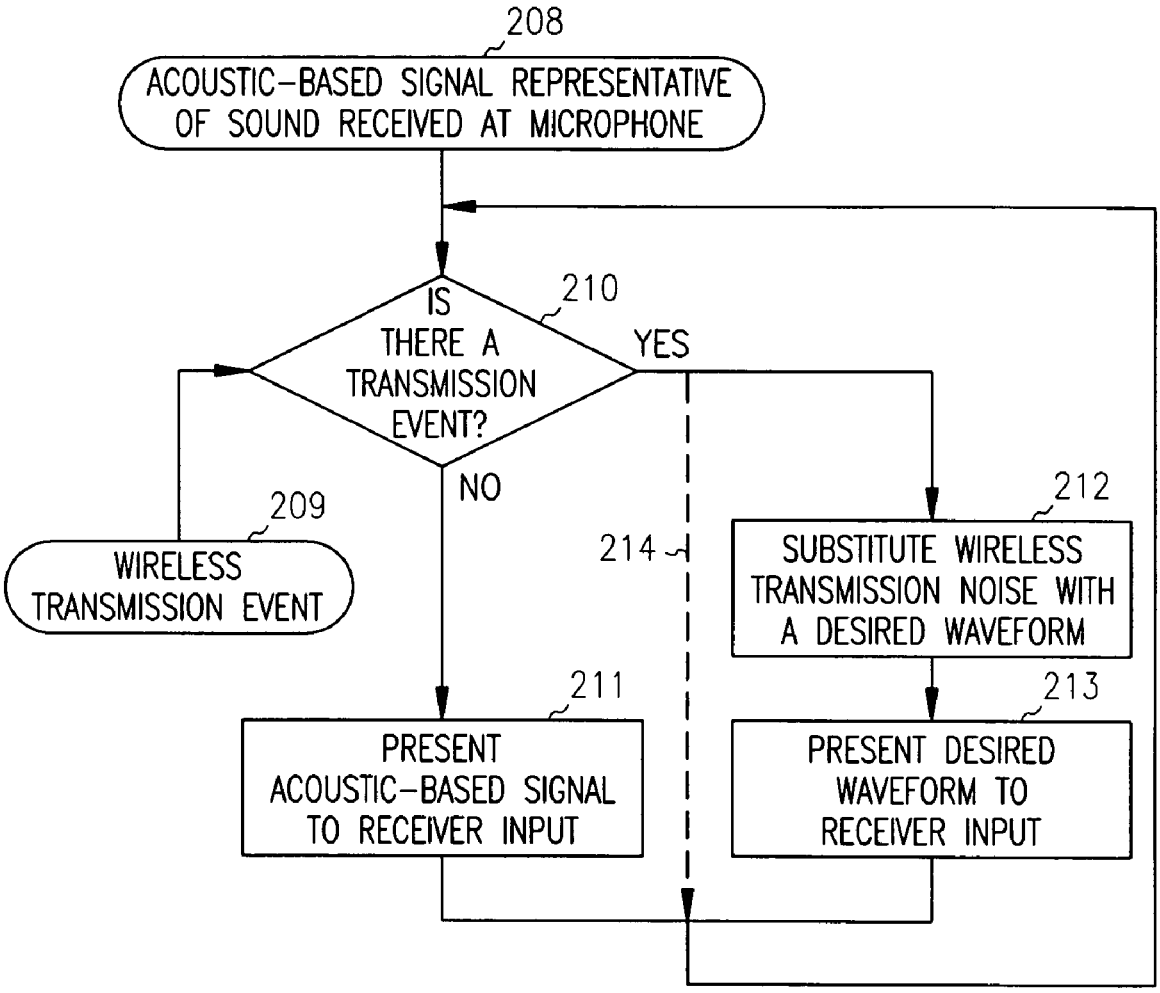
FIG. 2 illustrates a method for blocking data transmission interference from a receiver input via substitution, according to various embodiments of the present subject matter.

FIG. 2 illustrates a method for blocking data transmission interference from a receiver input via substitution, according to various embodiments of the present subject matter. The illustration includes two inputs. A first input, represented at 208, represents an acoustic based signal representative of sound received at a microphone system of the hearing aid. A second input, represented at 209, represents a wireless transmission event. At 210, a determination is made as to whether there is a transmission event. If a transmission event (or trigger for a transmission event) has not occurred, the acoustic-based signal is presented to an input of a hearing aid receiver, as represented at 211. In the illustrated embodiment, the method proceeds back to 210 to again determine whether there is a transmission event. The acoustic-based signal can pick up transmission noise if, at 210, a transmission event (or trigger for a transmission event) has occurred, the acoustic-based signal can pick up transmission noise. Thus, at 212, the wireless transmission noise is substituted with a desired waveform at 212, and the desired waveform is presented to a receiver input at 213. In the illustrated embodiment, the method proceeds back to 210 to again determine whether there is a transmission event. One of ordinary skill in the art will understand, upon reading and comprehending this disclosure, that in embodiments of the present subject matter in which the acoustic-based signal is blocked and another waveform is not substituted for the acoustic-based signal, the illustrated method proceeds from 210 along dotted line 214 to skip the presentation of the acoustic-based signal to the receiver input 211.

Figure 3:
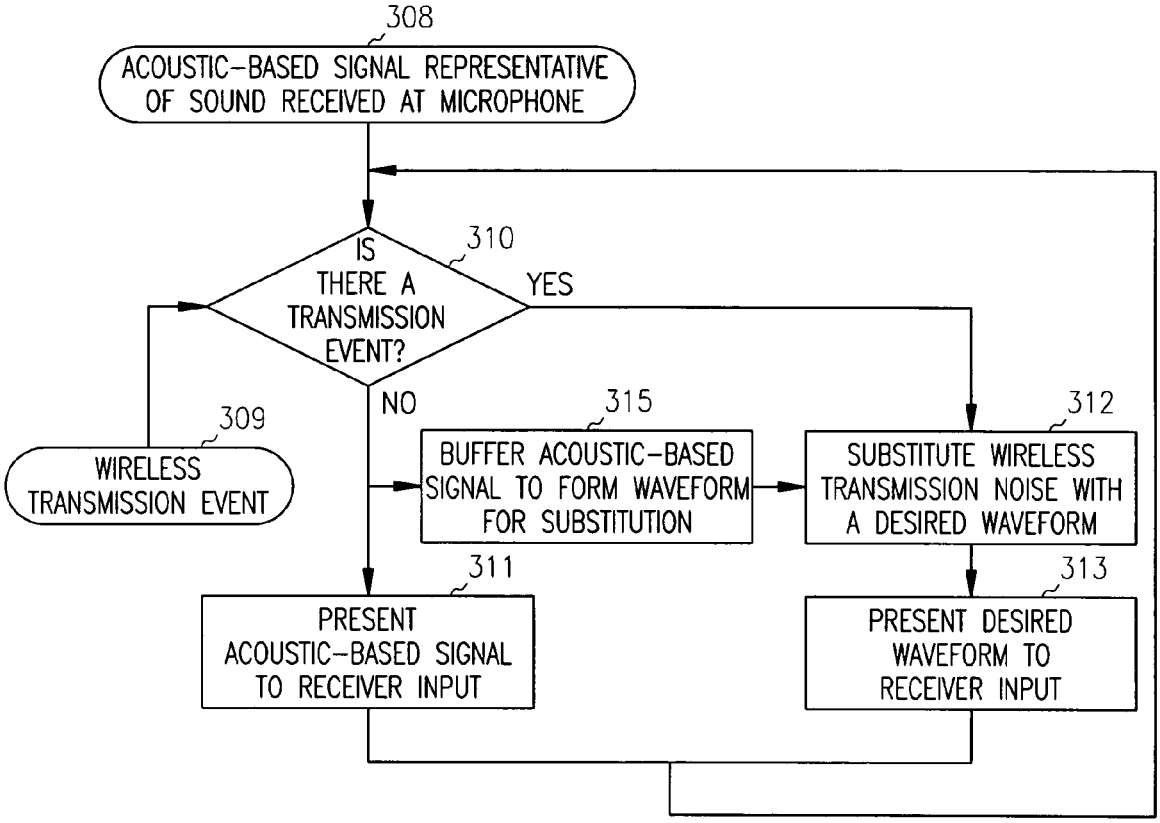
FIG. 3 illustrates a method for blocking data transmission interference from a receiver input via sampling and substitution, according to various embodiments of the present subject matter.

FIG. 3 illustrates a method for blocking data transmission interference from a receiver input via sampling and substitution, according to various embodiments of the present subject matter. A first input, represented at 308, represents an acoustic based signal representative of sound received at a microphone system of the hearing aid. A second input, represented at 309, represents a wireless transmission event. At 310, a determination is made as to whether there is a transmission event. If a transmission event (or trigger for a transmission event) has not occurred, the acoustic-based signal is presented to an input of a hearing aid receiver, as represented at 311. At 315, the acoustic-based signal is buffered, also referred to as sampled and stored, to form a desired waveform for substitution when there is a transmission event. Various embodiments buffer 1-50 ms of the acoustic-based signal. In the illustrated embodiment, the method proceeds from 311 back to 310 to again determine whether there is a transmission event. If, at 310, a transmission event (or trigger for a transmission event) has occurred, the wireless transmission noise is substituted with a desired waveform at 312, and the desired waveform is presented to a receiver input at 313. The substituted waveform was previously sampled and stored from the acoustic-based signal at a time preceding the transmission event. In the illustrated embodiment, the method proceeds back to 310 again determine whether there is a transmission event.

Figure 4:
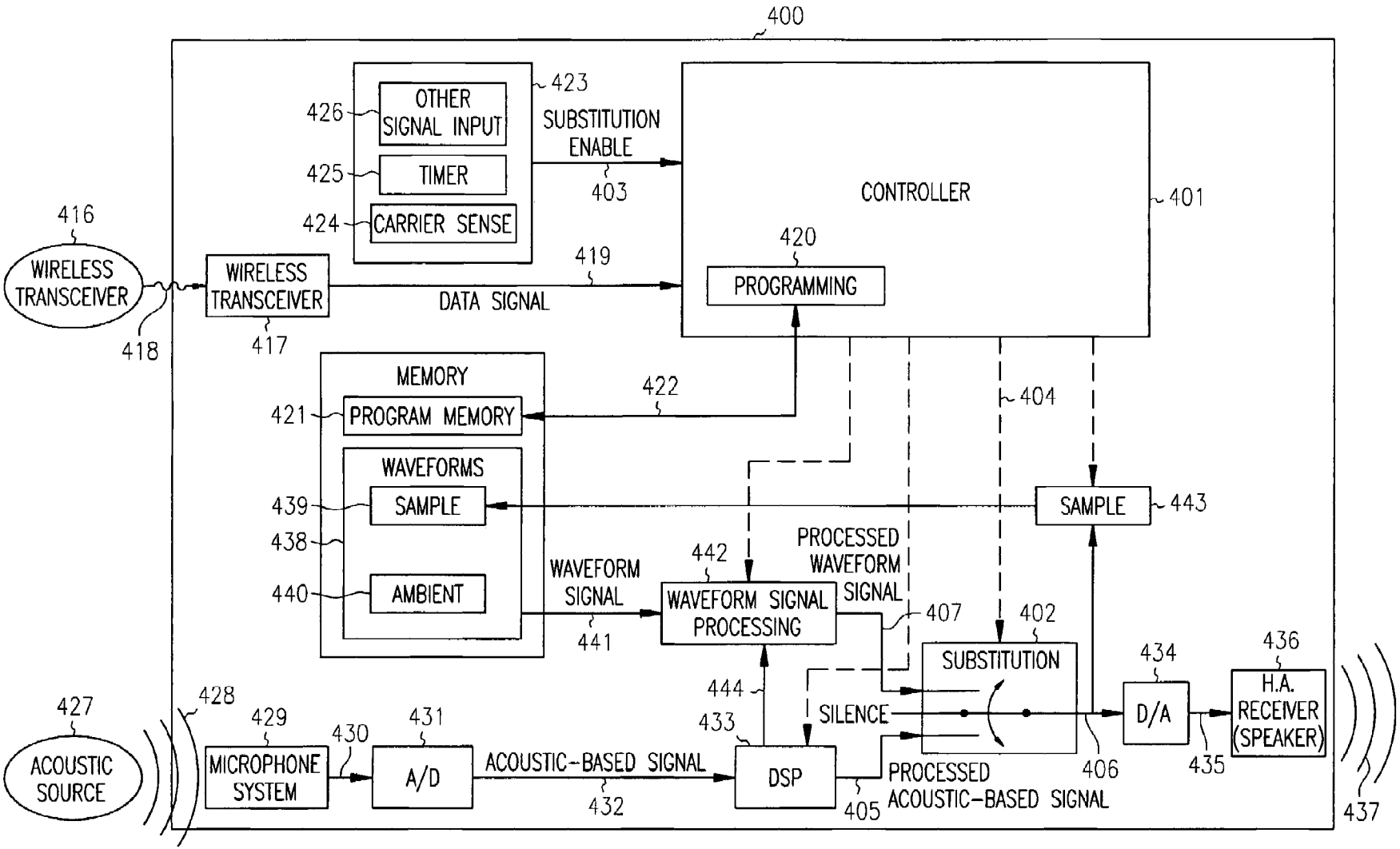
FIG. 4 illustrates a block diagram of a hearing instrument, according to various embodiments of the present subject matter.

FIG. 4 illustrates a block diagram of a hearing instrument, according to various embodiments of the present subject matter. The hearing instrument is illustrated as a hearing aid 400, which generally corresponds to hearing aid 100 of FIG. 1. As was illustrated in FIG. 1, the hearing aid 400 illustrated in FIG. 4 includes a controller 401 and a blocking module which is labeled in the illustration as a substitution module 402. The controller 401 is adapted to control various portions of the hearing aid, as generally represented by the dotted lines extending away from the controller 401. The controller 401 is adapted to receive a data signal trigger which is labeled as a substitution enable signal 403, and to appropriately control the substitution module 402 via control line 404 based on the substitution enable signal 403. The substitution module 402 receives an acoustic-based signal 405, and selectively passes the acoustic-based signal 405 through to line 406. In response to a substitution enable signal 403, the controller 401 controls the substitution module 402 to block the acoustic-based signal from passing through to line 406. By blocking the acoustic-based signal from the input of the receiver in response to the substitution enable signal 403, the present subject matter blocks data transmission interference from being converted into the output acoustic signal.

FIG. 4 further illustrates an external source of data or data source, represented as a wireless transceiver 416 that transmits a data signal to the hearing aid 400. In various embodiments, the hearing aid includes a wireless transceiver 417 adapted to wirelessly communicate with the external transceiver 416. The illustrated transceiver 417 receives a wireless data communication 418, and presents a corresponding data signal 419 to the controller 401. It is understood that the functions of the transceiver can be performed by a transmitter and a receiver. The illustrated controller 401 includes a programming module 420 used to program the hearing aid 400. The programming module 420 is adapted to store programming instructions in a program memory 421 via data path 422.

FIG. 4 also illustrates a trigger generator 423 to generate a substitution enable signal 403 corresponding to a data transmission event. In various embodiments, the trigger generator 423 includes a carrier sense module 424 used to sense a carrier wave of the data transmission and generate the substitution enable signal 403 when the data transmission carrier signal is sensed. In various embodiments, the trigger generator 423 includes a timer 425 used to anticipate a planned data transmission, and generate the substitution enable signal 403 in preparation for the planned data transmission. In various embodiments, the trigger generator 423 includes another signal input 426, as may be appropriate for a particular hearing aid design, used to signal a data transmission event or occurrence. One of ordinary skill in the art will understand, upon reading and comprehending this disclosure, that the data transmission occurs over a period of time, and that the substitution enable signal can be active for the entire period of time or a portion thereof FIG. 4 further illustrates an acoustic source 427, which generates sound. The generated sound is referred to herein as an input acoustic waveform 428. The hearing aid 400 includes a microphone system 429 to receive the input acoustic waveform 428 and generate an analog acoustic-based signal 430. The microphone system 429 includes one or more microphones and associated circuitry to perform the desired function. An analog-to-digital (A/D) converter 431 converts the analog acoustic-based signal 430 to a digital acoustic-based signal 432.

A digital signal processing (DSP) module 433 receives and processes the digital acoustic-based signal 432 for presentation to the hearing aid receiver. One of ordinary skill in the art will understand, upon reading and comprehending this disclosure, the functions of the DSP module. One such function includes filtering. The output of the DSP module 433 presents an acoustic-based signal 405, or more particularly a signal representative of the acoustic-based signal 430 generated by the microphone system 429, to the substitution module. The substitution module 402, under the control of the controller 401, selectively passes the acoustic-based signal 405 to a digital-to-analog (D/A) converter 434, which converts the digital output signal 406 to an analog output signal 435. The analog output signal 435 is presented to an input of the hearing aid receiver 436. The receiver 436 functions as a speaker, and produces an output acoustic signal 437 that is capable of being heard by the user of the hearing aid.

The hearing aid 400 includes a waveform memory 438. Data representative of substitute waveforms are capable of being stored in the waveform memory 438. The illustrated substitute waveforms include a sampled waveform 439 and a predetermined ambient waveform 440. A waveform signal is transmitted from the waveform memory 438 via path 441 to a waveform signal processing module 442. An output of the waveform signal processing module 442 presents a processed waveform signal on line 407 to the substitution module 402. The illustrated substitution module 402 is illustrated as a switch with three inputs: a processed waveform signal (e.g. sample or ambient waveforms) input; a silence input; and a processed acoustic-based signal input. The silence input is illustrated as a disconnected receiver 436, such as the situation when neither the processed acoustic-based signal at 405 nor the processed waveform signal at 407 are passed to the receiver 436. Various embodiments include only some of the above-described options, various embodiments include all of these options, and various embodiments include different waveform substitution options.

Various embodiments of the hearing aid 400 includes a sample module 443, which together with the waveform memory 438, is capable of functioning as a circular buffer. The signal at 406 is sampled by the sample module 443 and stored at 439 in the waveform memory 438. In various embodiments, the length of the stored sample waveforms is within a range of approximately 1 to 50 ms.

In various embodiments, the waveform signal processing module 442 is configured to adjust morphology parameters of the substitute waveform based on the morphology of the acoustic-based signal that precedes and succeeds data transmission. Thus, the waveform signal processing module 442 matches the frequency (pitch) and amplitude (volume) of the preceding and succeeding signals. In various embodiments, the morphology of the acoustic-based signal is determined from the sampled signals taken by the sample module 443. In various embodiments, the morphology of the acoustic-based signal is determined using the DSP module 433, which communicates this morphology information to the waveform signal processing module 442 via line 444.

Figure 5:
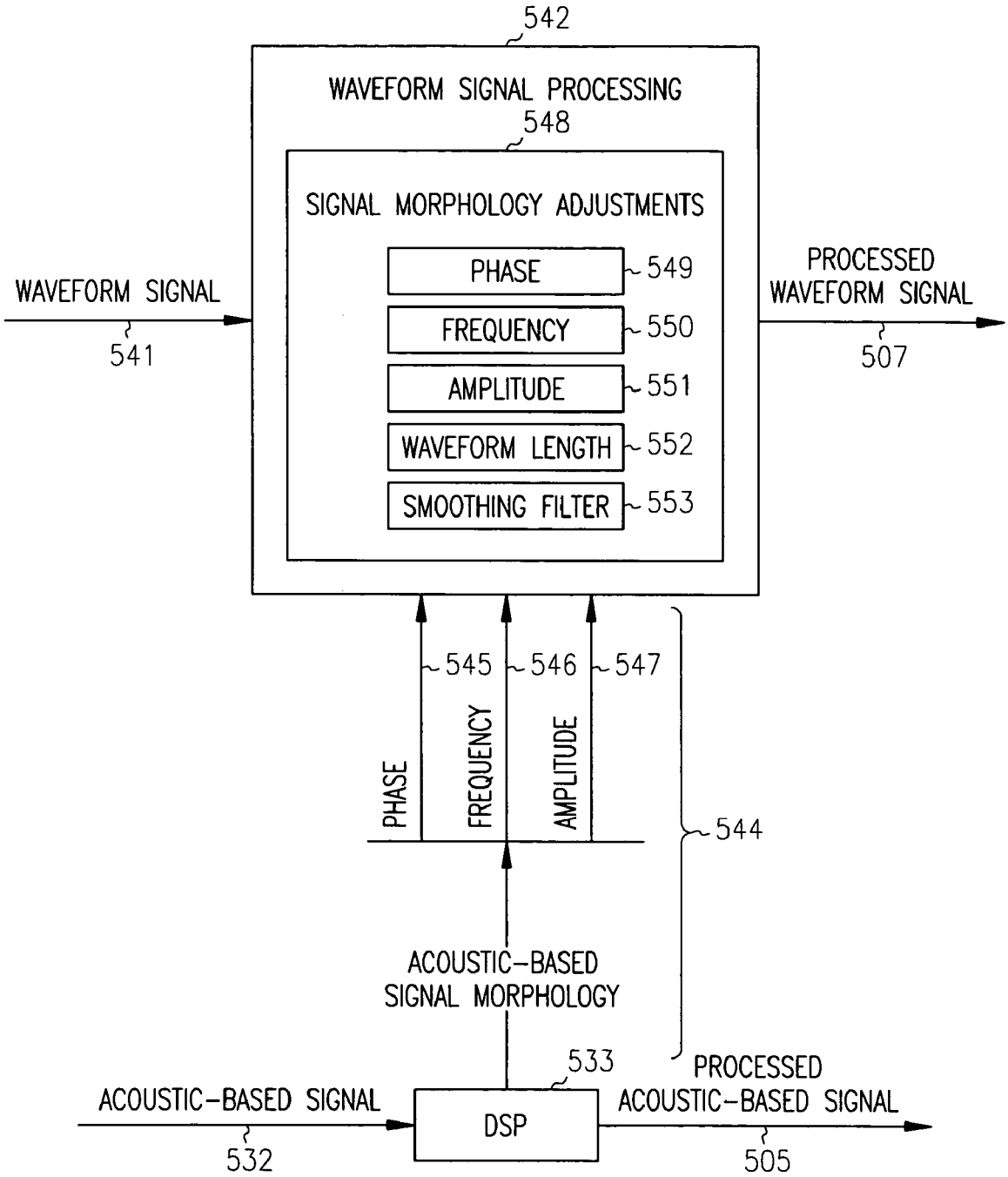
FIG. 5 illustrates a block diagram of the waveform signal processing module shown in FIG. 4, according to various embodiments of the present subject matter.

FIG. 5 illustrates a block diagram of the waveform signal processing module shown in FIG. 4, according to various embodiments of the present subject matter. The DSP module 533 receives an acoustic-based signal 532, and outputs a processed acoustic-based signal 505. The illustrated DSP module 533 also provides morphology information 544 for the acoustic-based signal for use by the waveform signal processing module 542. According to various embodiments, the morphology 544 includes phase information 545, frequency information 546 and amplitude information 547 associated with the acoustic-based signal. The waveform signal processing module 542 includes a module 548 for adjusting morphology of the substitute waveform signal 541. Various embodiments of module 548 include a phase adjustment portion 549 to adjust the phase of the substitute waveform signal 541. Various embodiments of module 548 include a frequency adjustment portion 550 to adjust the frequency or pitch of the substitute waveform signal 541. Various embodiments of module 548 include an amplitude portion 551 to adjust the amplitude or volume of the substitute waveform signal 541. Various embodiments of module 548 include a waveform length adjustment portion 552 to shorten the substitute waveform signal 541 by removing a front end portion and/or a back end portion of the substitute waveform signal 541. Various embodiments of module 548 include a smoothing filter portion 553 to smooth at least portions of the substitute waveform signal 541. Various embodiments of module 548 include any one or more of the phase, frequency, amplitude, waveform length, and smoothing filter portions, or various combinations thereof. Thus, the waveform signal processing module 542 is capable of providing a calculated waveform based upon the sounds immediately preceding the data transmission interference such that the resulting output acoustic signal from the receiver has the same pitch and volume and has its ends connected so that a user does not encounter a listening experience break during data transmissions and during transitions to and from data transmissions.

Figure 6:
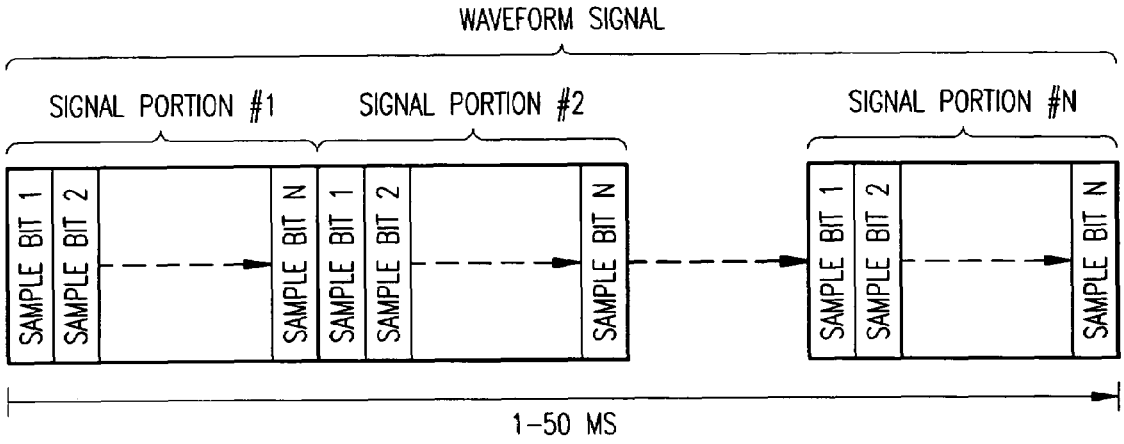
FIG. 6 illustrates a waveform signal processed by the waveform signal processing module shown in FIG. 5, according to various embodiments of the present subject matter.

FIG. 6 illustrates a waveform signal processed by the waveform signal processing module shown in FIG. 5, according to various embodiments of the present subject matter. The substitute waveform signal can be divided into a number of signal portions, with each portion including a number of bits. The waveform signal processing module 542 is capable of adjusting morphology parameters for any one, any combination or all of the signal portions. For example, in order to connect the ends of the waveform signal to the preceding and succeeding acoustic signals, the waveform signal processing module 542 can smooth Signal Portion #1 and Signal Portion #N appropriately to provide a desired signal connectivity between a preceding acoustic-based signal, the substitute signal, and the succeeding acoustic-based signal.

One of ordinary skill in the art will understand that, the modules and other circuitry shown and described herein can be implemented using software, hardware, and combinations of software and hardware. As such, the terms module and switch are intended to encompass software implementations, hardware implementations, and software and hardware implementations.

One of ordinary skill in the art will understand, upon reading and comprehending this disclosure, that the present subject matter is capable of being incorporated in a variety of hearing instruments that use such near-field communication systems such as hearing aids, programmers, and assisted listening systems. For example, the present subject mater is capable of being used in hearing aids such as in-the-ear, half-shell and in-the-canal styles of hearing aids, as well as for behind-the-ear hearing aids.

In various embodiments, the methods provided above are implemented as a computer data signal embodied in a carrier wave or propagated signal, that represents a sequence of instructions which, when executed by a processor cause the processor to perform the respective method. In various embodiments, methods provided above are implemented as a set of instructions contained on a computer-accessible medium capable of directing a processor to perform the respective method. In various embodiments, the medium is a magnetic medium, an electronic medium, or an optical medium.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. A method to block data transmission interference from an input of a receiver in a hearing instrument, comprising:

receiving an acoustic-based signal representative of sound received at a microphone system;

determining if a trigger associated with a data transmission has occurred;

presenting a signal representative of the acoustic-based signal to the input of the receiver when the trigger has not occurred such that the receiver converts the acoustic-based signal into an output acoustic signal;

blocking the signal representative of the acoustic-based signal from the input of the receiver when the trigger has occurred such that data transmission interference is blocked from being converted into the output acoustic signal; and controlling a presentation of a signal to the input of the receiver such that, when the trigger associated with a data transmission has occurred, the receiver either:

does not generate an output acoustic signal, or generates an output acoustic signal representative of a substitute waveform generated from data stored in a memory of the hearing instrument.

2. The method of claim 1, further comprising generating the trigger associated with the wireless transmission when a wireless transmission carrier has been sensed.

3. The method of claim 1, further comprising generating the trigger associated with the wireless transmission in anticipation of the wireless transmission.

4. The method of claim 1, further comprising generating the trigger associated with the wireless transmission for at least a portion of a wireless transmission duration.

5. The method of claim 1, wherein the output acoustic signal representative of the substitute waveform stored in the memory of the hearing instrument includes an output acoustic signal representative of a preprogrammed ambient sound.

6. The method of claim 1, further comprising:

sampling the signal representative of the acoustic-based signal; and storing data to form a sample waveform, wherein the output acoustic signal representative of the substitute waveform generated from data stored in the memory of the hearing instrument includes an output acoustic signal representative of the sample waveform.

7. The method of claim 1, wherein the output acoustic signal representative of the substitute waveform generated from data stored in the memory of the hearing instrument has a duration of 1 to 50 ms.

8. The method of claim 1, wherein the substitute waveform is generated from sampled data for a detected acoustic signal that precedes the data transmission.

9. The method of claim 1, wherein the output acoustic signal representative of the substitute waveform includes a first substitute acoustic signal corresponding to a predetermined ambient sound or a second substitute acoustic signal based on a detected acoustic signal that precedes the data transmission.

10. A hearing instrument, comprising:

a data receiver to receive a data transmission;

a microphone system to receive an input acoustic signal and generate an acoustic-based signal;

a hearing instrument receiver to receive and convert a processed signal representative of the acoustic-based signal into an output acoustic signal; and means for blocking the signal representative of the acoustic-based signal for at least a portion of a time period when the data receiver receives a data transmission such that the output acoustic signal does not include noise attributed to the data transmission and means for controlling a presentation of a signal to the input of the receiver such that, when the trigger associated with a data transmission has occurred, the receiver either:

does not generate an output acoustic signal, or generates an output acoustic signal representative of a substitute waveform generated from data stored in a memory of the hearing instrument.

11. The hearing instrument of claim 10, wherein the means for blocking and the means for controlling includes means for substituting the substitute waveform signal for the processed signal for at least a portion of a period when the data receiver receives a data transmission such that, when the substitute waveform is substituted for the processed signal, the hearing instrument receiver receives and converts the substitute waveform signal into an output acoustic signal.

12. The hearing instrument of claim 11, further comprising means for sampling the signal representative of the acoustic-based signal before the data transmission and form a corresponding sample waveform signal, wherein the means for substituting includes means for substituting the processed signal with the sample waveform signal such that the hearing instrument receiver receives and converts the sample waveform signal into an acoustic signal similar to an output acoustic signal generated prior to the data transmission.

13. A hearing instrument, comprising:

a data receiver to receive a data transmission;

a microphone system to receive an input acoustic signal and generate an acoustic-based signal;

a switch having a first input, a second input and an output, the switch being configured to selectively connect one of the first input and the second input to the output;

a first signal path to carry a signal representative of the acoustic-based signal from the microphone system to the first input of the switch;

a hearing instrument receiver to convert an output signal from the output of the switch into an output acoustic signal;

a memory including data stored in the memory representative of a substitute waveform signal;

a second signal path to carry a signal representative of the substitute waveform signal from the memory to the second input of the switch; and a controller to receive a trigger signal indicative of a data transmission occurrence, and to communicate with the switch to selectively disconnect the first input from the output during at least a portion of the data transmission occurrence such that interference associated with the data transmission occurrence is not transferred to the hearing instrument receiver and connect the second input to the output during at least a portion of the data transmission occurrence.

14. The hearing instrument of claim 13, wherein the data stored in the memory includes data representative of a predetermined ambient waveform signal to function as the substitute waveform signal.

15. The hearing instrument of claim 13, further comprising a sampling module to sample the output signal and form a sample waveform signal, wherein the data stored in the memory includes data representative of the sample waveform signal to function as the substitute waveform signal.

16. The hearing instrument of claim 13, further comprising:

a digital signal processing module to receive and process the acoustic-based signal from the microphone system and to determine waveform morphology information about the acoustic-based signal; and a waveform signal processing module to receive the substitute waveform signal from the computer-readable medium, to receive the waveform morphology information from the digital signal processing module, and to adjust morphological parameters of the substitute waveform signal based on the waveform morphology information from the digital signal processing module.

17. The hearing instrument of claim 13, wherein at least one of the switch and the controller is implemented using software.

18. The hearing instrument of claim 13, wherein at least one of the switch and the controller is implemented using hardware.

19. A hearing instrument, comprising:

a wireless transceiver to receive a wireless data transmission and convert the wireless data transmission into a data signal;

a controller to receive the data signal and store programming instructions contained in the data signal for the hearing instrument in a program memory module;

a trigger generator to send a trigger signal to the controller, the trigger signal corresponding to a wireless data transmission occurrence;

a microphone system to receive an acoustic signal and covert the acoustic signal into an analog acoustic-based signal;

an analog-to-digital converter to convert the analog acoustic-based signal into a digital acoustic-based signal;

a digital signal processing module to transform the digital acoustic-based signal into a processed acoustic-based signal;

a blocking module to selectively block the processed acoustic-based signal from passing as a digital output signal, wherein in response to the trigger signal, the controller operates to selectively block the processed acoustic-based signal from passing as the digital output signal, and further operates to control a presentation of a signal to the input of the receiver such that either the receiver does not generate an output acoustic signal or the receiver generates an output acoustic signal representative of a substitute waveform generated from data stored in a memory of the hearing instrument;

a digital-to-analog converter to convert the digital output signal into an analog output signal; and a receiver to convert the analog output signal into an acoustic signal.

20. The hearing instrument of claim 19, wherein the data stored in the memory includes data to construct a predetermined substitute waveform signal representative of ambient sound.

21. The hearing instrument of claim 19, further comprising a sample module to sample a preceding digital output signal corresponding to a preceding processed acoustic-based output signal, and to store a sample waveform corresponding to the preceding digital output signal as data in the memory for use in generating the substitute waveform.

22. The hearing instrument of claim 19, wherein a waveform signal processing module is configured to receive morphology information corresponding to a previous acoustic-based signal, and to adjust morphological parameters of the substitute waveform.

23. The hearing instrument of claim 22, wherein the morphological parameters that are capable of being adjusted by the waveform signal processing module, include: phase, frequency and amplitude.

24. The hearing instrument of claim 22, wherein the waveform signal processing module includes a module to adjust a length of the substitute waveform.

25. The hearing instrument of claim 22, wherein the waveform signal processing module includes a module to smooth ends of the substitute waveform to connect a first end of the substitute waveform to a preceding acoustic-based waveform and to connect a second end of the substitute waveform to a succeeding acoustic-based waveform.

26. The hearing instrument of claim 9, wherein the substitute waveform has a duration of 1 to 50 ms.

27. The hearing instrument of claim 19, wherein the trigger signal corresponds to an entire time period associated with the wireless data transmission.

28. The hearing instrument of claim 19, wherein the trigger signal corresponds to at least a portion of a time period associated with the wireless data transmission.

29. The hearing instrument of claim 19, further comprising a carrier sense module to sense a carrier associated with the wireless data transmission, wherein the trigger signal corresponds a sensed carrier.

* * * * *

UNITED STATES PATENT AND TRADEMARK OFFICE

CERTIFICATE OF CORRECTION

PATENT NO. : 7,283,639 B2
APPLICATION NO. : 10/797317
DATED : October 16, 2007
INVENTOR(S) : Kariniemi It is certified that error appears in the above-identified patent and that said Letters Patent is hereby corrected as shown below:

In column 6, line 32, after "thereof" insert -- . --.

In column 12, line 31, in Claim 26, delete "claim 9," and insert -- claim 19, --, therefor.

Signed and Sealed this

Eighteenth Day of December, 2007

JON W. DUDAS
*Director of the United States Patent and Trademark Office*